US006036535A

United States Patent [19]

Whiteman, Jr. et al.

[11] Patent Number: 6,036,535

[45] Date of Patent: Mar. 14, 2000

[54] CABLE END CAP FOR POWER CABLE TAP CONNECTOR

[75] Inventors: Robert Neil Whiteman, Jr., Middletown; Earl William McCleerey, Mechanicsburg; Robert Wayne Walker, Harrisburg, all of Pa.

[73] Assignee: The Whitaker Corporation, Wilmington, Del.

[21] Appl. No.: 09/170,349

[22] Filed: Oct. 13, 1998

Related U.S. Application Data

[60] Provisional application No. 60/064,991, Nov. 10, 1997.

[51] Int. Cl.[7] ..... H01R 13/516

[52] U.S. Cl. ..... 439/519; 439/892

[58] Field of Search ..... 439/519, 410, 439/521, 892, 934

[56] References Cited

U.S. PATENT DOCUMENTS 5,967,823 10/1999 Tsui ..... 439/280

OTHER PUBLICATIONS

U.S. application No. 09/056,083, filed Apr. 7, 1998 (Abstract and drawings only).

*Primary Examiner*—Neil Abrams
*Assistant Examiner*—Eugene G. Byrd

[57] ABSTRACT

Cable tap connector (10) applied to a cable (12) at an end thereof. End cap (70) is urged over the cable end (72) for sealing thereof and includes projections (84) that seat in openings (82) of either the connector housing (20) or the connector cover (22).

8 Claims, 2 Drawing Sheets

CABLE END CAP FOR POWER CABLE TAP CONNECTOR

Provisional application No. 60/064,991 filed Nov. 10, 1997 has been filed herewith.

FIELD OF THE INVENTION

The present invention is related to the field of electrical connectors and more particularly to cable connectors.

BACKGROUND OF THE INVENTION

A cable tap connector has been devised that is useful for establishing taps to cables such as heavily jacketed cables having a plurality of conductors for transmission of electrical power, or transmission of both power and signals. It is desired to provide for sealing of the cable end when the cable tap connector is applied to the cable at an end thereof.

SUMMARY OF THE INVENTION

The present invention is an end cap that is placed over the end portion of a cable for sealing, and is securably affixed to the cable tap connector when the connector is applied to the cable. The end cap includes a pocket for receipt of the cable end thereinto in a friction fit, and also includes projections that extend from the cable-receiving face to be secured in recesses of the cable tap connector at a cable exit thereof.

An embodiment of the present invention will now be described by way of example with reference to the accompanying drawings.

DETAILED DESCRIPTION

Figure 1:
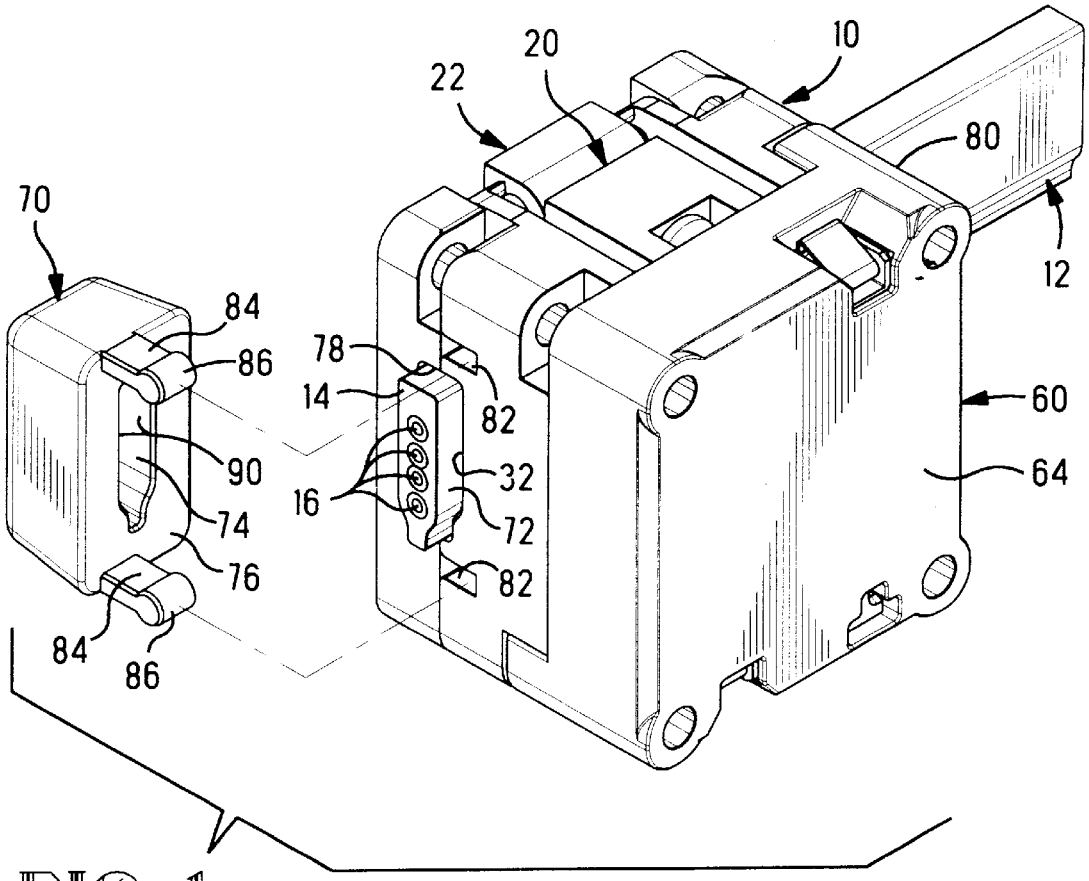
FIG. 1 is an isometric view of a cable tap connector terminated to a cable with an end cap of the present invention secured to the connector over the cable end.

Cable tap connector 10 is shown terminated to a cable 12 having an outer jacket 14 and, for example, four conductors 16. Connector 10 includes an insulative housing 20 and a second insulative member, cover 22 to which it is securable to surround cable 12 at any location whether at a cable end as shown, or remote from an end of the cable. A terminator module 60 is shown affixed to cable connector 10 at a mating interface 62 thereof, and includes a resistor therein electrically connected between the signal circuits to dissipate the energy of the signal circuits at the end of the cable to eliminate reflections. The outer surface 64 of the terminator module opposed from its first mating interface is imperforate. Terminator module 60 is disclosed in greater detail in U.S. patent application Ser. No. 09/170.631 (Whitaker Case No. 17104), filed Oct. 13, 1998 (concurrently herewith); and cable tap connector 10 is disclosed in U.S. patent application Ser. No. 09/056,083 filed Apr. 7, 1998, both assigned to the assignee hereof.

Figure 2:
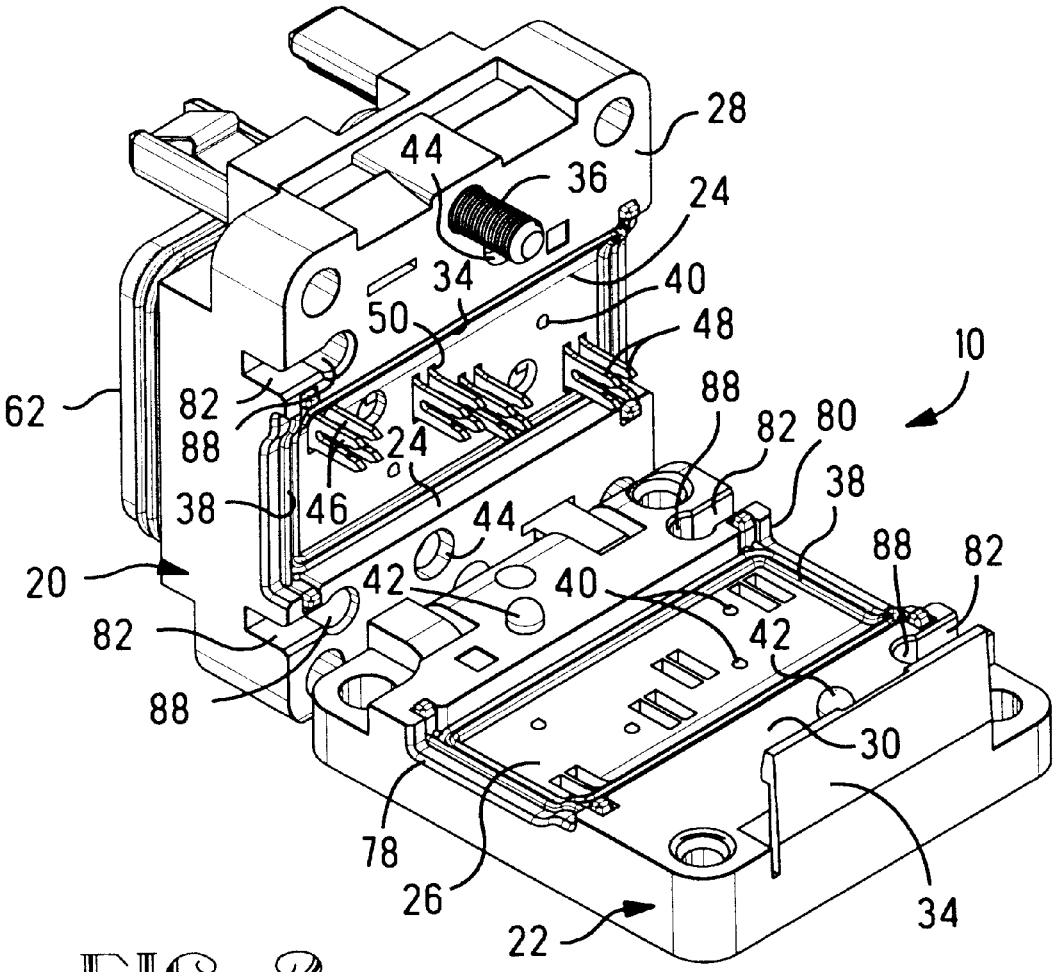
FIG. 2 is an isometric view of the connector opened to illustrate the assembly faces thereof.

Referring to FIG. 2, housing 20 and cover 22 include shallow wide grooves 24,26 along assembly faces 28,30 thereof together defining cable-receiving channel or nest 32 that will clamp about the cable. The cable cross-section is shown to include a reduced thickness flange along one side, serving to polarize the orientation of the cable tap connector with respect to the cable, its cable-receiving channel being complementarily shaped, thus assuring that the power conductors and signal conductors are positioned appropriately for termination to the appropriate contact members of the connector. Housing 20 pivots with respect to cover 22 to clamp around the cable, then latches by means of latch arm 34 after which a pair of fasteners 36 complete the securing of connector 10 to cable 12.

Also shown are gaskets 38 such as of elastomeric material that may be affixed to assembly faces 28,30 within respective gasket grooves to seal the termination region after termination, from moisture, dust and gasses of the outside environment; alternatively, sheets of mastic material may be used for sealing. Teeth 40 extend into grooves 24,26 to bite into cable 12 to assist in securing the cable in position against lateral movement. Antishear embossments 42 project from assembly face 30 of cover 22 to enter clearances 44 in assembly face 28 of housing 20 upon securing the connector to the cable, that enhance resistance to shearing should forces be applied to either the housing or the cover in a lateral direction. Contacts 46 are illustrated in their fully actuated position in FIG. 2; insulation displacement contact sections 48 are shown extending from slots 50 upon actuation to penetrate insulation 14 of cable 12 and compressively engage a conductor 16 by receiving it into IDC slots 52 between beams 54, establishing an electrical connection therewith. Contact sections 48 are recessed within slots 50 while the housing and the cover are being secured around the cable and then fastened to each other, after which the contacts are actuated to translate the contact sections into cable-receiving channel 32 for IDC sections to penetrate the cable insulation and terminate to the conductors.

An end cap 70 of elastomeric material such as of butyl nitrile resin, is securable to the cable tap connector over an end portion 72 of cable 12 extending from cable exit 78 of the connector for sealing. End cap 70 includes a pocket 74 into surface 76 to receive thereinto and surround and enclose the end portion 72 of cable 12 prior to placement in connector 10; the end cap is shown exploded from connector 10 for illustration purposes only, because the end cap would be already affixed to connector 10 when the connector has been applied to cable 12 as shown.

End cap 70 is adapted to be located at either cable exit 78,80 dependent upon which of the cable exits is associated with cable end portion 72. Both housing 20 and cover 22 include a pair of openings 82 at the cable exits and adjacent thereto on both sides, with openings 82 of housing 20 located at cable exit 78 and openings 82 of cover 22 located at cable exit 80.

End cap 70 includes a pair of projections 84 extend from surface 76 from one side of pocket 74 to be inserted into openings 82 into either cover member 22 or housing 20 of connector 10, with enlarged embossments 86 at ends of projections 84 seated within corresponding enlarged recesses 88 along openings 82 (see FIGS. 2 and 3) and thereafter selfretain to cable tap connector 10, when the cable portion and end cap are placed within the connector. It can be seen that with openings 82 in both the housing and the cover member, cable tap connector 10 is adapted to be placed at either cable end, by easily orienting the end cap appropriately, for projections 78 to correspond with either the openings 80 of the housing or the openings of the cover.

Figure 3:
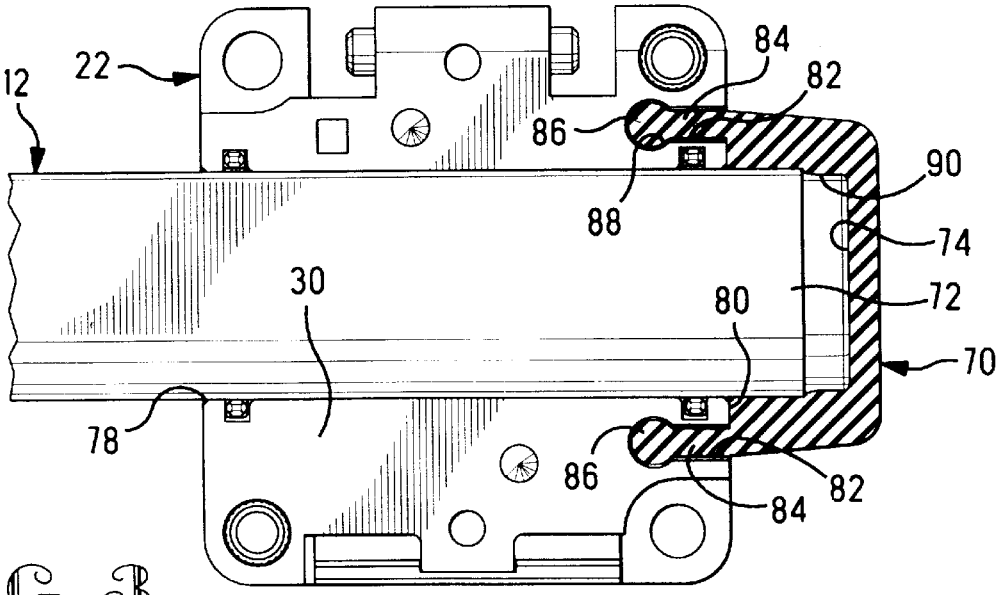
FIG. 3 is a plan view of the connector cover with the cable seated therein, and the end cap in cross-section.

To illustrate that the end cap is usable at either cable end, FIG. 3 shows end cap 70 being positioned at cable exit 80, whereas FIG. 1 shows end cap 70 associated with cable exit 78. End cap 70 is shown in cross-section in FIG. 3, with the projections 84 also shown in cross-section although they would be approximately flush with assembly face 30 of cover 22. Pocket 74 is shaped and dimensioned to compressively engage with cable end portion 72 for sealing. Side wall surfaces 90 are slightly tapered, and are slightly deformed by the cable upon being urged over cable end portion 72. Preferably, end cap 70 is urged over the cable end portion and into a friction fit therewith and then the cable and end cap are positioned at the desired cable exit with the cable disposed along the cable-receiving groove of either the housing or the cover so that projections 78 to be seated within openings 82 of either the housing or the cover at the selected cable exit.

What is claimed is:

1. A cable end cap for a cable terminated by an electrical connector at an end of the cable, comprising:

a member of resilient material including a cable-receiving face and a cable-receiving pocket extending into said cable-receiving face, said cable-receiving pocket having a pocket bottom and opposed side walls and opposed top and bottom walls, said opposed side and top and bottom walls being tapered toward opposed ones of each other at least adjacent said pocket bottom to a cross-sectional dimension less than width and height dimensions of a cross-section of said cable, whereby said side and end walls compress in a friction fit against outer surfaces of an insulative jacket of said cable upon sufficient insertion of an end portion of said cable into said cable-receiving pocket, to sealingly surround said cable end portion.

2. A cable end cap as set forth in claim 1 wherein said member includes a retention section for affixing said member to said electrical connector adjacent a cable exit thereof.

3. A cable end cap as set forth in claim 2 wherein said retention section comprises a pair of retention arms extending orthogonally from said cable-receiving face from respective sides of said cable-receiving pocket.

4. An assembly of an electrical connector and a cable end cap for sealing an end of a cable to which the electrical connector is terminated, comprising:

said electrical connector including a housing and an opposed member fastenable to each other, said housing and said opposed member defining between cable faces thereof a cable nest extending between opposed cable exits such that a short length of said cable extends beyond one of said cable exits and said cable extends continuously beyond the other thereof; and said cable end cap is a member of resilient material including a cable-receiving face and a cable-receiving pocket extending into said cable-receiving face, said cable-receiving pocket having a pocket bottom and opposed side walls and opposed top and bottom walls, said opposed side and end walls being tapered toward opposed ones of each other at least adjacent said pocket bottom to a cross-sectional dimension less than width and height dimensions of a cross-section of said cable; and said electrical connector and said end cap include cooperating retention members to secure said cable end cap to said connector to enclose said end portion of said cable extending from said one cable exit, whereby said side and end walls of said cable-receiving pocket compress in a friction fit against outer surfaces of an insulative jacket of said cable upon sufficient insertion of said end portion of said cable into said cable-receiving pocket and securing said cable end cap to said connector, to sealingly surround said cable end portion.

5. An assembly as set forth in claim 4 wherein said retention section of said cable end cap comprises a pair of retention arms extending orthogonally from said cable-receiving face; and said retention section of said electrical connector comprises at least one of said housing and said opposed member including a pair of openings located proximate respective sides of said one cable exit and communicating with said cable face thereof.

6. An assembly as set forth in claim 5 wherein said retention arms of said cable end cap are offset from a central plane of said cable nest to be recessed into said cable face of said at least one of said housing and said opposed member including said pair of openings.

7. An assembly as set forth in claim 6 wherein said housing includes a said pair of said openings adjacent one of said one or other of said cable exits, and said opposed member includes a said pair of said openings adjacent the other of said one or other of said cable exits, whereby said cable end cap is securable to said electrical connector at either of said one or other of said cable exits by appropriately orienting said cable end cap to align said offset retention arms with said openings.

8. An assembly as set forth in claim 5 wherein said openings include enlarged recesses therealong, and said retention arms of said cable end cap include enlarged embossments at ends thereof, whereby said cable end cap is assuredly secured to said electrical connector.

* * * * *